US008932023B2

(12) United States Patent
Hart

(10) Patent No.: US 8,932,023 B2
(45) Date of Patent: Jan. 13, 2015

(54) ROTOR WHEEL FOR A TURBOMACHINE

(75) Inventor: Andrew Clifford Hart, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 391 days.

(21) Appl. No.: 13/350,063

(22) Filed: Jan. 13, 2012

(65) Prior Publication Data

US 2013/0183156 A1 Jul. 18, 2013

(51) Int. Cl.
*F01D 5/30* (2006.01)

(52) U.S. Cl.
USPC ..... 416/215

(58) Field of Classification Search
CPC ..... F01D 5/3038; F01D 5/32; F01D 5/303; F05D 2240/80; F05D 2260/30; Y02T 50/673
USPC ..... 416/215–218, 219 R; 29/889.21, 889.22
See application file for complete search history.

(56) References Cited

U.S. PATENT DOCUMENTS

| | | | | |
|---|---|---|---|---|
| 883,891 | A * | 4/1908 | Kieser | 416/189 |
| 2,393,447 | A | 1/1946 | Allen | |
| 3,216,700 | A | 11/1965 | Bostock, Jr. | |
| 3,923,420 | A | 12/1975 | Chifos | |
| 4,255,086 | A * | 3/1981 | Roberts | 416/218 |
| 4,451,204 | A * | 5/1984 | Pask | 416/215 |
| 5,522,706 | A | 6/1996 | Mannava et al. | |
| 5,584,658 | A * | 12/1996 | Stenneler | 416/215 |
| 6,752,598 | B2 * | 6/2004 | Antunes et al. | 416/215 |
| 2006/0083621 | A1 * | 4/2006 | Klingels | 416/215 |
| 2006/0269417 | A1 * | 11/2006 | Triconnet et al. | 416/220 R |
| 2011/0008171 | A1 * | 1/2011 | Tsumura et al. | 416/218 |
| 2011/0116933 | A1 * | 5/2011 | Aiello | 416/215 |

FOREIGN PATENT DOCUMENTS

| | | | |
|---|---|---|---|
| EP | 1650405 | A1 | 4/2006 |
| EP | 1726786 | A1 | 11/2006 |
| FR | 2227426 | A1 | 11/1974 |

OTHER PUBLICATIONS

Search Report and Written Opinion from EP Application No. 13151063.8 dated Apr. 29, 2013.

* cited by examiner

*Primary Examiner* — Edward Look
*Assistant Examiner* — Aaron R Eastman
(74) *Attorney, Agent, or Firm* — Cantor Colburn LLP

(57) ABSTRACT

A rotor wheel for a turbomachine includes a rotor wheel body having a first face and an opposing second face joined by an outer diameter surface having a centerline. A blade receiving slot is formed in the outer diameter surface and extends about the rotor wheel body. A blade loading slot is formed in the outer diameter surface. The blade loading slot is connected with and axially off-set from the blade receiving slot.

12 Claims, 5 Drawing Sheets

ROTOR WHEEL FOR A TURBOMACHINE

BACKGROUND OF THE INVENTION

The subject matter disclosed herein relates to the art of turbomachine and, more particularly, to a rotor wheel for a turbomachine.

Turbomachines typically include a compressor portion, a turbine portion, and a combustor assembly. Air is passed through a number of compressor stages in the compressor portion and is compressed to form compressed air. A portion of the compressed air is passed to the combustor assembly, mixed with a combustible fluid, and combusted to form gases that are passed to the turbine portion. The gases expand through a number of turbine stages to create work. Each of the compressor stages and turbine stages include a rotor wheel to which is mounted a plurality of blades or buckets. The buckets react to the airflow or gases and impart a rotational force to the rotor wheel.

The buckets are typically mounted to the rotor wheel through a dovetail attachment. Generally, the blade will include a pin and the rotor wheel will include a tail or slot. The slot is configured to receive the pin on the blade. In some cases, the slot extends laterally across an outer diameter surface of the rotor wheel. In such cases, the rotor wheel will include a slot for each blade. In other cases, the slot extends circumferentially about the outer diameter surface of the rotor wheel. In such cases, the slot is off-set from a centerline of the outer diameter surface and will include a loading portion. The loading portion is configured to receive each blade. Each blade is mounted to the rotor wheel and manipulated into place about the outer diameter surface. Once all blades are mounted, locking features are secured to the rotor wheel near the loading portion to prevent blade liberation.

BRIEF DESCRIPTION OF THE INVENTION

According to one aspect of the exemplary embodiment, a rotor wheel for a turbomachine includes a rotor wheel body having a first face and an opposing second face joined by an outer diameter surface having a centerline. A blade receiving slot is formed in the outer diameter surface and extends about the rotor wheel body. A blade loading slot is formed in the outer diameter surface. The blade loading slot is connected with and axially off-set from the blade receiving slot.

According to another aspect of the exemplary embodiment, a turbomachine includes a compressor portion, a turbine portion mechanically linked to the compressor portion, a combustor assembly fluidly connected to the compressor portion and the turbine portion, and a rotor wheel mounted in one of the compressor portion and the turbine portion. The rotor wheel includes a rotor wheel body having a first face and an opposing second face joined by an outer diameter surface having a centerline. A blade receiving slot is formed in the outer diameter surface and extends about the rotor wheel body. A blade loading slot is formed in the outer diameter surface. The blade loading slot is connected with and off-set from the blade receiving slot.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
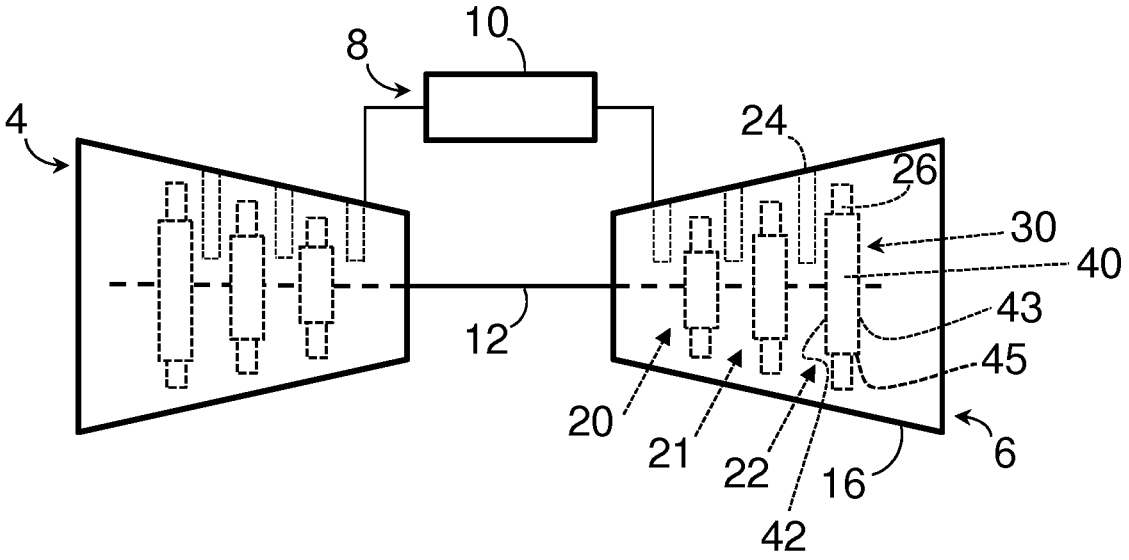
FIG. 1 is a schematic diagram of a turbomachine including a rotor wheel in accordance with an exemplary embodiment.

A turbomachine in accordance with an exemplary embodiment is illustrated generally at 2 in FIG. 1. Turbomachine 2 includes a compressor portion 4 fluidly linked to a turbine portion 6 through a combustor assembly 8. Combustor assembly 8 includes a plurality of combustors, one of which is indicated at 10, arranged in an annular array. Of course it should be understood that combustor assembly 8 can take on a variety of forms. Compressor portion 4 is also mechanically linked to turbine portion 6 through a common compressor/turbine shaft 12. Turbine portion 6 is shown to include a turbine housing 16 that encloses a number of turbine stages 20, 21, and 22. The number of turbine stages could vary. Each turbine stage 20-22 includes a corresponding plurality of stationary airfoil members or nozzles, such as indicated at 24 in connection with stage 22, arranged upstream from a plurality of rotating airfoil members or blades, such as shown at 26. Rotating airfoil members 26 are mounted to a rotor wheel 30 within turbine portion 6.

With this arrangement, air is drawn into compressor portion 4 through an intake (not shown) the air is compressed through a plurality of compressor stages (not separately labeled) to form a compressed airflow. A portion of the compressed airflow is passed to combustor assembly 8 and mixed with a combustible fluid in each combustor 10 to form a combustible mixture. The combustible mixture is combusted to form combustion gases that are directed to turbine portion 6. The combustion gases expand through stages 20-22 creating work that is used to power an external component such as a generator or pump. Of course, turbomachine 2 could also be used as a power source for a vehicle.

Figure 2:
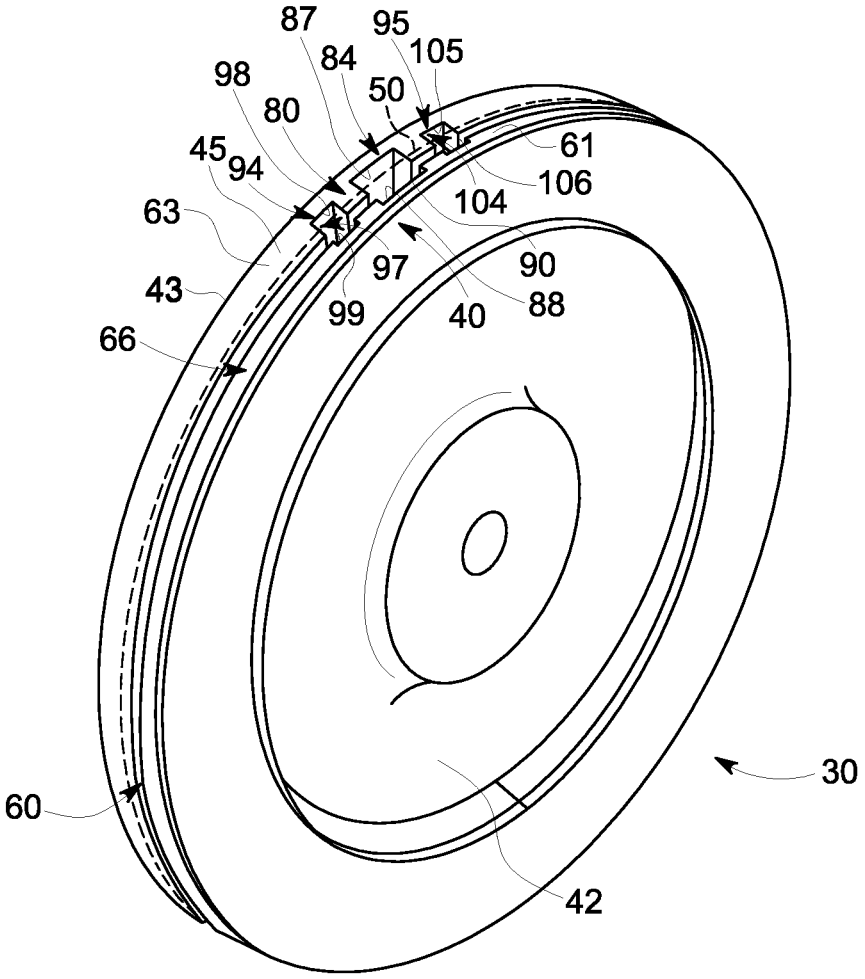
FIG. 2 is a perspective view of the rotor wheel in accordance with an exemplary embodiment.
Figure 3:
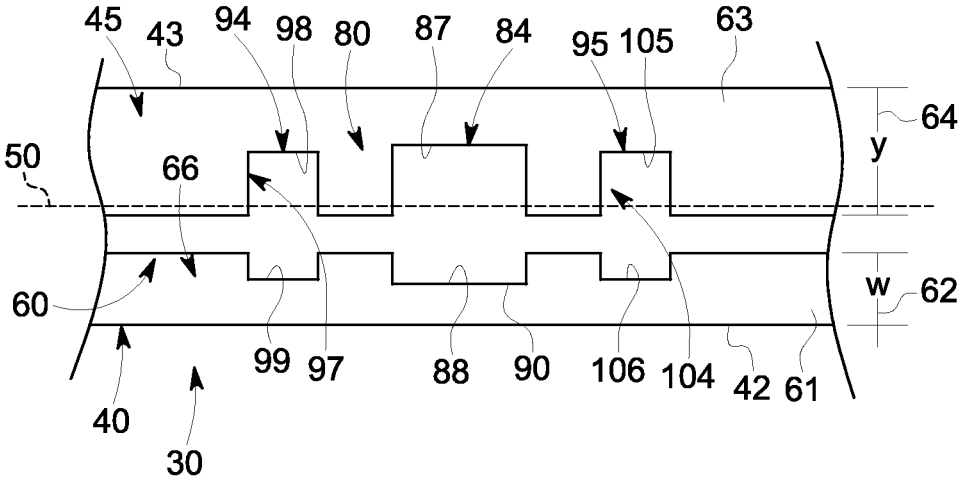
FIG. 3 is a plan view of an outer diameter surface of the rotor wheel of FIG. 2 illustrating a blade receiving slot having a blade loading slot in accordance with an exemplary embodiment.
Figure 4:
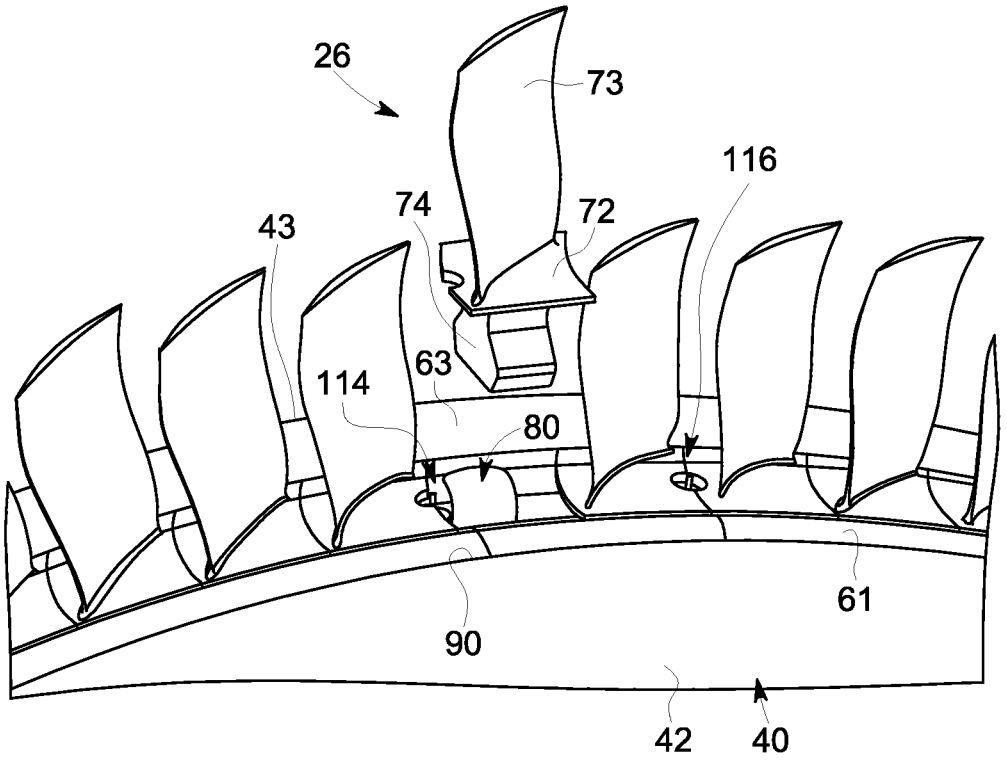
FIG. 4 is a partial perspective view of the rotor wheel of FIG. 2 illustrating a blade being inserted into the blade loading slot in accordance with an exemplary embodiment.

In accordance with the exemplary embodiment illustrated in FIGS. 2-7, rotor wheel 30 includes a rotor wheel body 40 having a first face 42 and an opposing second face 43 that are joined by an outer diameter surface 45 having a centerline 50 such as shown in FIGS. 2-3. A blade receiving slot 60 is formed in outer diameter surface 45. Blade receiving slot 60 supports plurality of rotating airfoil members 26 about outer diameter surface 45. Blade receiving slot 60 divides outer diameter surface 45 into a first surface section 61 having a first dimension 62 and a second surface section 63 having a second dimension 64. In the exemplary embodiment shown, second dimension 64 is greater than first dimension 62 such causing blade receiving slot 60 to be axially offset relative to centerline 50.

Figure 5:
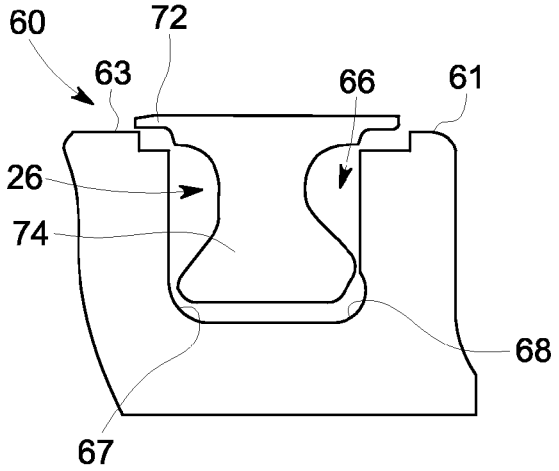
FIG. 5 is a cross-sectional side view of the blade loading slot in accordance with an exemplary embodiment illustrating a blade inserted into the blade receiving slot.
Figure 6:
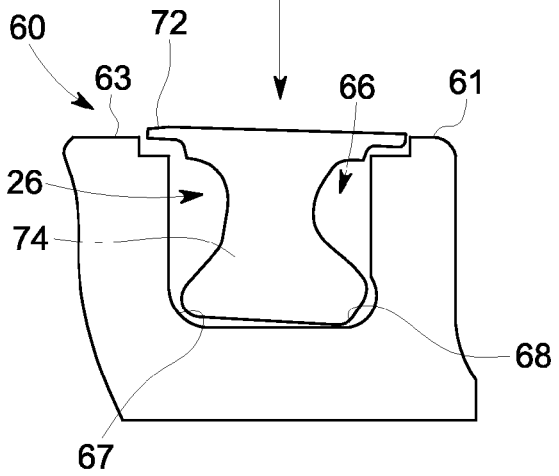
FIG. 6 is a cross-sectional side view of the blade receiving slot of FIG. 5 illustrating the blade being manipulated to sit into the blade receiving slot.
Figure 7:
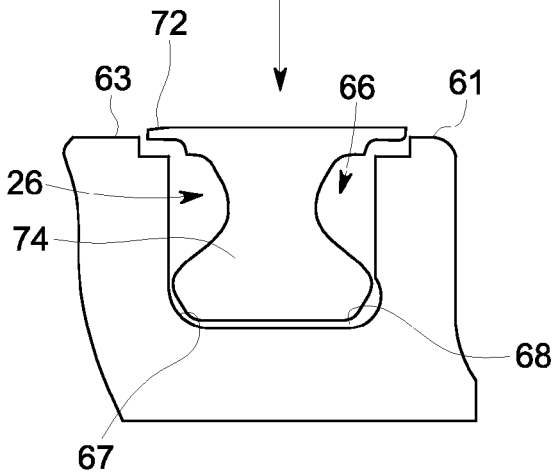
FIG. 7 is a cross-sectional side view of the blade loading slot illustrating the blade seated in the blade receiving slot.

Blade receiving slot 60 includes an interior cavity 66 formed in rotor wheel body 40. In the exemplary embodiment shown, interior cavity 66 includes a first tail portion 67 and a second tail portion 68. First and second tail portions 67 and 68 are asymmetric. That is, second tail portion 68 extends axially into rotor wheel body to a depth that is greater than a depth of first tail portion 67. With this arrangement, each of the plurality of rotating airfoil members 26 must be manipulated into blade receiving slot 60. More specifically, each of the plurality of rotating airfoil members 26 includes a base portion 72 that supports an airfoil portion 73 and a mounting member or pin 74. Mounting member 74 is shaped to nest within blade receiving slot 60. As will be discussed more fully below, each of the plurality of rotating airfoil members 26 is guided into blade receiving slot 60 such as shown in FIG. 5, manipulated or axially angled such as shown in FIG. 6, and then nested into blade receiving slot 60 with mounting member 74 extending into first and second tail portions 67 and 68.

In further accordance with the exemplary embodiment, blade receiving slot 60 includes a blade loading slot 80 formed in rotor wheel body 40. Blade loading slot 80 includes an opening 84 defined by first and second wall portions 87 and 88 that is sized to receive mounting member 74. Blade loading slot is axially off-set from blade receiving slot 60. More specifically, first wall portion 87 extends into second surface portion 63 to a depth that is greater than a depth that second wall portion 88 extends into first surface portion 61. In this manner, blade loading slot is located more centrally in outer diameter surface 45 to move areas of stress concentration to a more robust portion of rotor wheel 30. During operation, stresses concentrate at an interface 90 between first surface portion 61 and first face 42. The exemplary embodiment locates blade loading slot 80 more centrally along outer diameter surface 45 to ensure increase an overall width of first surface portion 61 so as to provide additional structure to support stresses at interface 90.

The location of blade loading slot 80 can vary so as to offset stresses at one or another of first and second faces 42 and 43. That is, if it has been found that stresses in first face 42 are greater than stresses in second face 43, blade loading slot 80 may be moved away from first face 42 to reduce localized stresses. Generally, stresses have been found to be greater in the one of first and second faces exposed to higher temperatures. As such, in a compressor portion, a downstream face of rotor wheel 30 might be subjected to elevated temperatures. As a result, stresses in the downstream face are higher than those found in the upstream face. Accordingly, when rotor wheel 30 is mounted in a compressor portion, blade loading slot 80 may be offset toward the upstream face to balance stresses in rotor wheel body 40. In contrast, in a turbine portion, an upstream face of rotor wheel 30 may be subjected to higher temperatures. As a result, stresses in the upstream face may be higher than those found in the downstream face. As such, when rotor wheel 30 is mounted in a turbine portion, blade loading slot 80 may be offset toward the downstream face to balance stresses in rotor wheel body 40. While the above description describes stresses in terms of thermal differences, other factors can affect stresses in rotor wheel 30. As such, moving the blade loading slot away from the face having the higher stress may not always be in a direction away from the face experiencing higher temperatures.

The blade loading slot 80 in accordance with the exemplary embodiment may be moved to balance stresses between first and second faces 42 and 43 to prolong an overall operational life of rotor wheel body 40. In particular, balancing stress between first and second faces 42 and 43 will increase a low cycle fatigue life (LCF) of rotor wheel 30. As such, rotor wheel body 40 will be better suited to endure turbomachine starting forces. In addition, increasing LCF of rotor body 40 will lead to a decrease in repair costs, maintenance costs, and costs per start associated with turbomachine 2.

Figure 8:
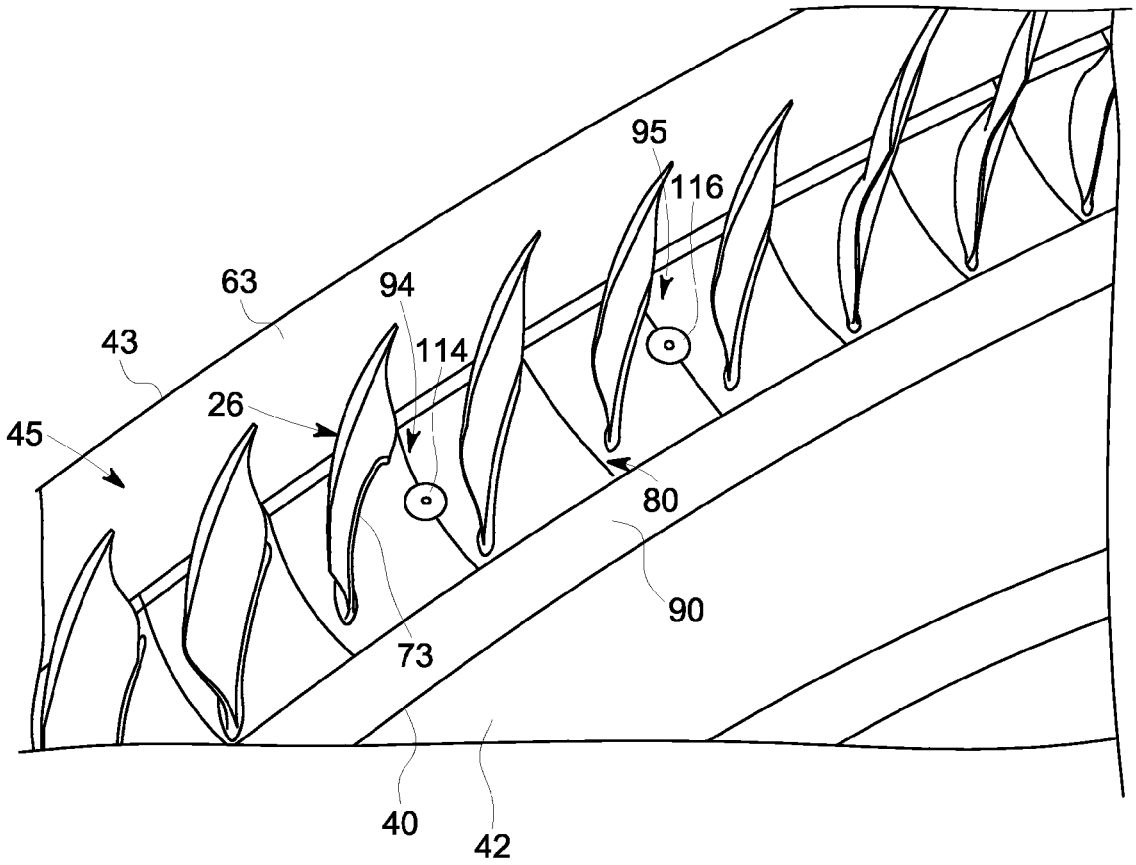
FIG. 8 is a partial perspective view of the rotor wheel of FIG. 2 illustrating the blade being locked into place with first and second locking members inserted into corresponding first and second locking slots in accordance with an exemplary embodiment.

In still further accordance with the exemplary embodiment, rotor wheel 30 includes first and second blade locking slots 94 and 95 arranged on either side of blade loading slot 80. First blade locking slot 94 includes an opening 97 defined by first and second wall sections 98 and 99. Similarly, second blade locking slot 95 includes an opening 104 defined by first and second wall sections 105 and 106. In a manner similar to that described above, first and second locking slots 94 and 95 are axially offset relative to blade receiving slot 60 to provide increased strength at first surface portion 61. Blade locking slots 94 and 95 are configured to receive corresponding blade locking members 114 and 116 illustrated in FIG. 8 that engage with two of the plurality of rotating airfoil member 26 to prevent airfoil member liberation.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A rotor wheel for a turbomachine comprising:

a rotor wheel body having a first face and an opposing second face joined by an outer diameter surface having a centerline;

a blade receiving slot formed in the outer diameter surface extending about the rotor wheel body, the blade receiving slot dividing the outer diameter surface into a first surface section proximate the first face having a first dimension and a second surface section proximate the second face having a second dimension greater than the first dimension; and a blade loading slot formed in the outer diameter surface, the blade loading slot being connected with and off-set from the blade receiving slot, wherein the blade loading slot extends into the first surface section a first distance and into the second surface section a second distance, the second distance being greater than the first distance.

2. The rotor wheel according to claim 1, further comprising: first and second blade locking slots formed in the outer diameter surface, the first and second blade locking slots being connected to the blade receiving slot and separated by the blade loading slot.

3. The rotor wheel according to claim 2, wherein each of the first and second blade locking slots extend into the second surface section more than into the first surface section.

4. The rotor wheel according to claim 2, further comprising: first and second blade locking members arranged respectively in the first and second blade locking slots.

5. The rotor wheel according to claim 1, further comprising: a plurality of blades mounted in the blade receiving slot.

6. A turbomachine comprising:

a compressor portion;

a turbine portion mechanically linked to the compressor portion;

a combustor assembly fluidly connected to the compressor portion and the turbine portion; and a rotor wheel mounted in one of the compressor portion and the turbine portion, the rotor wheel comprising:

a rotor wheel body having a first face and an opposing second face joined by an outer diameter surface having a centerline;

a blade receiving slot formed in the outer diameter surface extending about the rotor wheel body, the blade receiving slot dividing the outer diameter surface into a first surface section proximate the first face having a first dimension and a second surface section proximate the second face having a second dimension greater than the first dimension; and a blade loading slot formed in the outer diameter surface, the blade loading slot being connected with and off-set from the blade receiving slot, wherein the blade loading slot extends into the first surface section a first distance and into the second surface section a second distance, the second distance being greater than the first distance.

7. The turbomachine according to claim 6, further comprising: first and second blade locking slots formed in the outer diameter surface, the first and second blade locking slots being connected to the blade receiving slot and separated by the blade loading slot.

8. The turbomachine according to claim 7, wherein each of the first and second blade locking slots extend into the second surface section more than into the first surface section.

9. The turbomachine according to claim 7, further comprising: first and second blade locking members arranged respectively in the first and second blade locking slots.

10. The turbomachine according to claim 6, further comprising: a plurality of blades mounted in the blade receiving slot.

11. The turbomachine according to claim 6, wherein the rotor wheel is mounted in the compressor portion, one of the first and second faces constituting an upstream face and the other of the first and second faces constituting a downstream face, the downstream face having greater stress than the upstream face, the blade loading slot being off-set from the downstream face so as to balance stress in the rotor wheel body.

12. The turbomachine according to claim 6, wherein the rotor wheel is mounted in the turbine portion, one of the first and second faces constituting an upstream face and the other of the first and second faces constituting a downstream face, the upstream face having greater stress than the downstream face, the blade loading slot being off-set from the upstream face so as to balance stress in the rotor wheel body.

* * * * *